US007310838B2

(12) United States Patent
Goldstein

(10) Patent No.: US 7,310,838 B2
(45) Date of Patent: Dec. 25, 2007

(54) CONVERTIBLE BED HAVING SEPARABLE INTERLEAVED TONGUES

(76) Inventor: David Mordekhay Goldstein, 25/27 Clarendon Road, London, England (GB) N8 0DD ( * ) Notice: Subject to any disclaimer, the term of this patent is extended or adjusted under 35 U.S.C. 154(b) by 0 days.

(21) Appl. No.: 11/502,716

(22) Filed: Aug. 14, 2006

(65) Prior Publication Data

US 2007/0000046 A1 Jan. 4, 2007

(51) Int. Cl.
*A47C 17/13* (2006.01)
*A47C 17/04* (2006.01)

(52) U.S. Cl. ..... 5/18.1; 5/12.2

(58) Field of Classification Search ..... 5/201, 5/200.1, 12.2, 12.1, 18.1, 181, 183, 942, 5/17

See application file for complete search history.

(56) References Cited

U.S. PATENT DOCUMENTS

| | | | | | |
|---|---|---|---|---|---|
| 49,412 | A | * | 8/1865 | Iske | 5/618 |
| 53,188 | A | * | 3/1866 | Rose | 5/18.1 |
| 84,147 | A | * | 11/1868 | Streit | 5/18.1 |
| 97,403 | A | * | 11/1869 | Hudson | 5/183 |
| 117,775 | A | * | 8/1871 | Hart et al. | 5/18.1 |
| 124,265 | A | * | 3/1872 | Graves | 5/18.1 |
| 134,359 | A | * | 12/1872 | Caro | 5/183 |
| RE5,275 | E | * | 2/1873 | Caro | 5/183 |
| RE9,099 | E | * | 2/1880 | Streit | 5/18.1 |
| 326,918 | A | * | 9/1885 | Pritchard | 5/183 |
| 539,567 | A | * | 5/1895 | Beldin | 5/183 |
| 748,847 | A | * | 1/1904 | De Vault | 5/183 |
| 788,392 | A | * | 4/1905 | Bradley | 5/183 |
| 954,594 | A | * | 4/1910 | Shaw | 297/233 |
| 1,631,811 | A | * | 6/1927 | Guenther | 297/188.11 |
| 1,721,647 | A | * | 7/1929 | Stoltenberg | 5/18.1 |
| 3,450,072 | A | * | 6/1969 | Farkas | 108/102 |
| 5,096,258 | A | * | 3/1992 | Mestre Boix | 297/233 |
| 5,392,475 | A | * | 2/1995 | McCall et al. | 5/18.1 |
| 6,135,545 | A | * | 10/2000 | Liao | 297/124 |
| 7,086,108 | B1 | * | 8/2006 | Litvak | 5/723 |
| 2007/0000046 | A1 | * | 1/2007 | Goldstein | 5/18.1 |

FOREIGN PATENT DOCUMENTS

| | | | |
|---|---|---|---|
| GB | 2079591 | A * | 1/1982 |
| WO | WO 9104694 | A1 * | 4/1991 |

* cited by examiner

*Primary Examiner*—Robert G. Santos
(74) *Attorney, Agent, or Firm*—Richard L. Mikesell

(57) ABSTRACT

A convertible bed frame capable of being converted between sofa and bed states while interlocking tongues forming the seating portion allow the bed to be either a single or double bed.

16 Claims, 5 Drawing Sheets

32b
32a
10
32
30
34
20
14
28
21
19
23
18
17
16
12
26
25
24
27
22

CONVERTIBLE BED HAVING SEPARABLE INTERLEAVED TONGUES

FIELD OF THE INVENTION

The invention is in the field of convertible beds, including sofa beds.

BACKGROUND OF THE INVENTION

Two common examples of conventional convertible beds are folding frame sofa beds and futons. Folding frame sofa beds typically consist of a metal frame having several sub-frames connected by hinges about which the sub-frames can rotate. Converting the sofa bed between the sofa state and the bed state requires rotating the sub-frames relative to one another to fold or unfold the frame, often with the aid of a lever arrangement. For example, a prior art folding frame sofa bed is described in International Publication No. WH 03/049579 to Comodo Italia SRL.

There are several inconvenient aspects of this design. Firstly, the frame is heavy, particularly when combined with the padding for the sofa seat and mattress. As a result, rotating portions of the frame to convert the sofa bed is a tiring and difficult operation. To counteract this problem, lever arrangements have been developed to reduce the force required to move the frame. However, such arrangements increase the complexity of the sofa bed and the number of moving parts in it, which leads to an increase in the cost of the bed and a decrease in the reliability of the mechanism. Furthermore, since converting the bed involves temporarily lifting part of the heavy frame into an unsupported position, there is a risk that the user may be injured if the frame falls suddenly, either due to carelessness or a fault in the frame.

Futons are generally simpler in design than folding frame sofa beds and typically consist of a wooden frame having arm sections, a back section and a seat section. The back and seat sections are mounted between the arm sections on movable joints in such a way that they can both slide horizontally and rotate between a sofa position in which the back section is upright and the seat section is at an angle, and a bed position in which both sections are horizontal. Typically a futon has a single piece of padding functioning as both cushion and mattress, which must be manually rearranged when the futon is converted between the sofa and bed states. One such futon is disclosed in U.S. Pat. No. 6,715,166 to Grossman et al.

In one common design, the back section is connected to the arm sections by plastic or metal pegs which are free to move in grooves in the arm sections. The seat section of the futon is hinged on the bottom edge of the back section in such a way that it is free to rotate in a vertical plane.

As in the case of the folding frame sofa bed, the frame and mattress of the futon are heavy and bulky objects, and the process of converting the futon is difficult. Care must be exercised in pulling the seat forward, the first step of conversion between the sofa state and the bed state, to avoid the back section suddenly falling into its bed position under its own weight, which can lead to breakage or injury. Furthermore, the need for multiple joints increases the complexity and cost of the futon. The joints formed by the pegs and the grooves in the wooden arm sections are subjected to large stresses during conversion, which can result in damage to the wood, Prior art convertible beds can only be converted into one bed, either a single or a double bed depending on the particular design.

OBJECTS OF THE INVENTION

One of the objects of the present invention is to at least partially solve the above problems in the prior art by providing a simpler convertible bed having fewer moving parts, which can be converted easily.

It is a further object to provide a convertible bed which may be converted into either one or two single beds, or into a double bed.

It is a further object of this invention to provide a bed that in the closed state occupies a similar floor space to a standard sofa or single bed.

It is a still further object of this invention to provide a bed that is easily assembled and disassembled for shipping or long term storage.

BRIEF DESCRIPTION OF THE DRAWINGS

Embodiments of the present invention will now be described by way of further example only and with reference to the accompanying drawings, in which.

SUMMARY OF THE INVENTION

Figure 1:
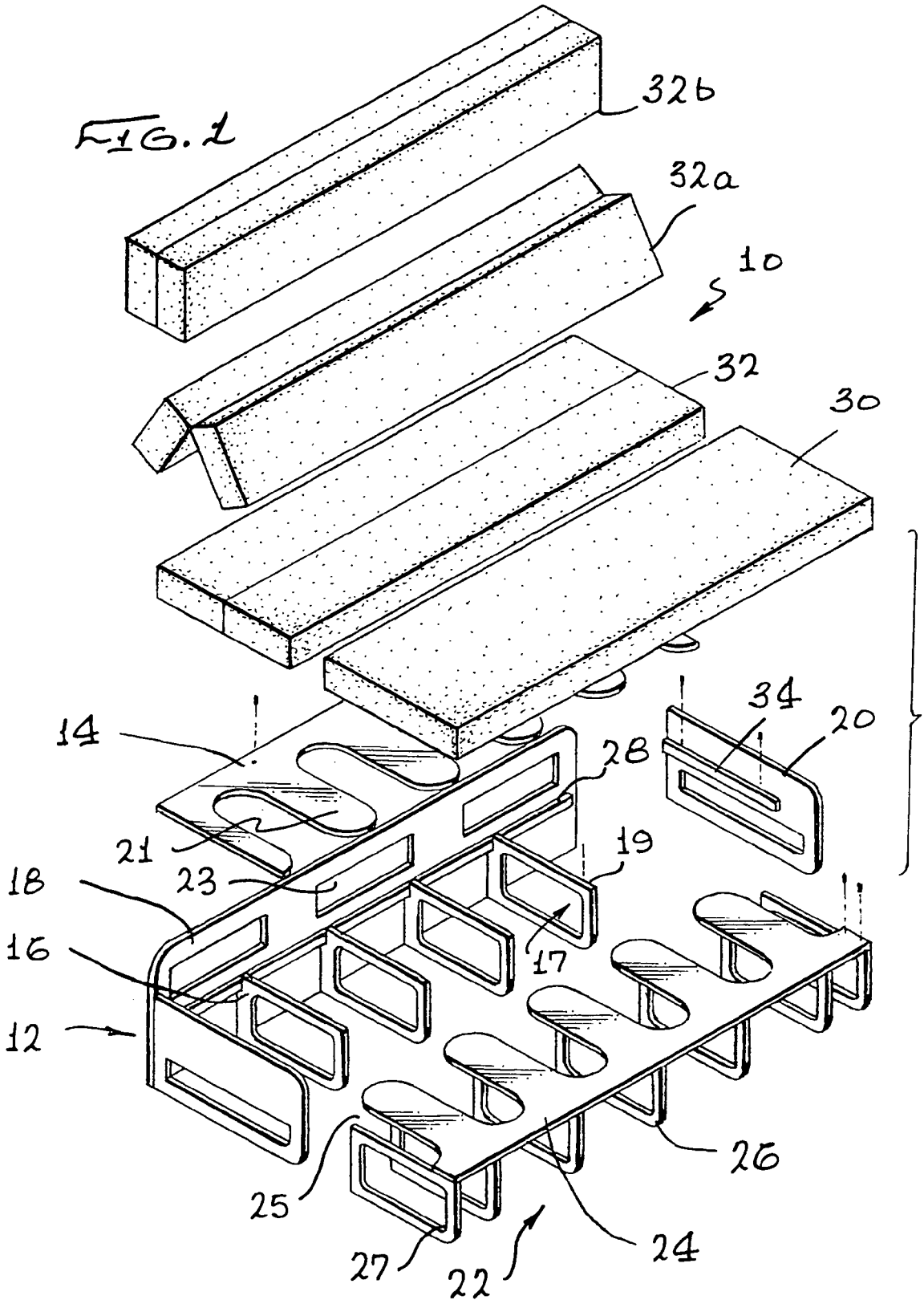
FIG. 1 is a partially exploded perspective view illustrating the components of a sofa bed according to the invention, together with a typical cushion.
Figure 2:
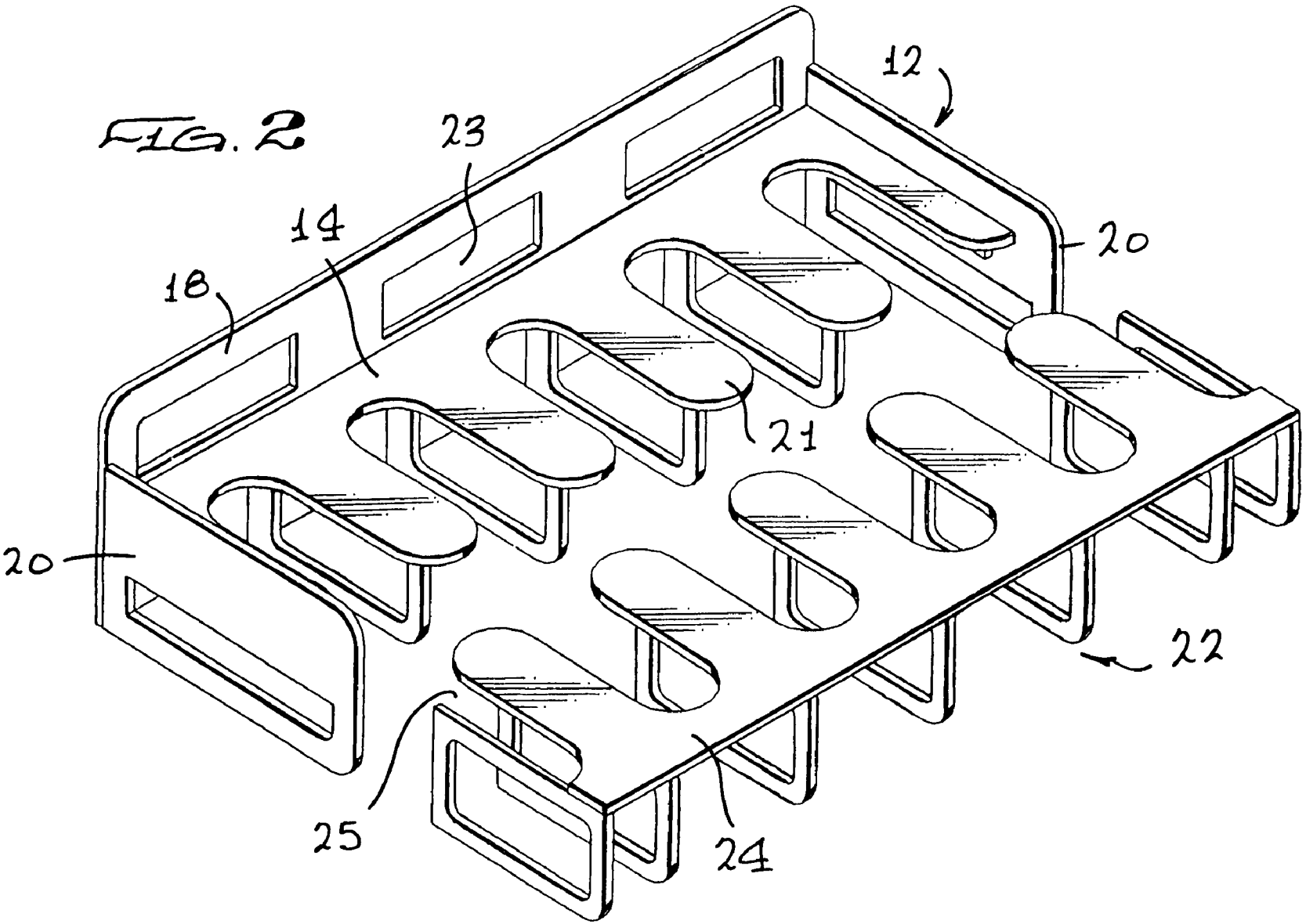
FIG. 2 illustrates a sofa bed frame according to the invention in an open state.

In a first aspect of the present invention, there is provided a convertible bed frame comprising a first bed section and a second bed section, wherein the first and second bed sections are separable; the first bed section comprising a first support section having a plurality of tongues spaced apart along its length; and the second bed section comprising a second support section having a plurality of tongues spaced apart along its length at positions corresponding to spaces between the tongues of the first support section; wherein the first and second bed sections are movable between a closed state, in which the tongues of the first support section are interleaved between the tongues of the second support section, and an open state, in which the tongues of the first and second support sections are less interleaved than in the closed state. Each tongue of the first and second support sections has an associated leg element extending from the tongue on the base side of the support section.

When the bases of the leg elements are placed on a horizontal surface the support sections have a substantially horizontal upper surface and the tongues of the support elements extend in a substantially horizontal direction.

In addition to the basic sofa bed frame as describe above, a backrest attachable to one of the first and second support sections may be provided. Preferably, the backrest is removably attachable to the support section.

The bed of the invention provides the advantage that it may be converted by simply sliding the two bed sections apart, requiring no vertical rotation of the frame by the user. Furthermore, since the bed requires no pivoting mechanism or moving parts other than the bed sections themselves, the manufacture of the bed is simplified and the cost of the bed is reduced, The flexibility provided by the two separable bed sections means that the bed may be converted into either one or two single beds, or into a double bed. Due to the interleaved tongues of the support sections, in the closed state the bed occupies a similar floor space to a standard sofa or single bed.

PREFERRED EMBODIMENT OF THE INVENTION

Preferably each leg element comprises a rectangular frame. More preferably each leg element has at least one rounded corner on a base side thereof. The rectangular frame construction of the leg elements provides strength and stability while having a lower weight than an equivalent solid leg. The rounded corners allow the bed sections to slide across a floor surface easily.

More preferably, the sofa bed frame further comprises at least one leg element, extending from a base side of one of the first and second support sections, which also forms an armrest.

In one embodiment, each of the backrest and the armrests has at least one aperture formed therein.

Conveniently, there is provided a bed comprising a bed frame as defined above, further comprising a first mattress and a second mattress, wherein the second mattress comprises two sections joined by a foldable seam.

Preferably, the support sections are formed from a wood material. In one embodiment, the wood material is plywood sheet.

All of the major components of the bed frame can be formed from plywood sheet and attached using screws. As a result, the bed can be supplied flat-packed and can be easily assembled by the purchaser without requiring specialist skills or tools. Furthermore, the use of plywood sheet provides a lightweight and strong construction.

Suitably, there is provided a kit comprising an unassembled bed frame as defined above. Preferably, the kit further comprises instructions for assembling the bed frame.

Preferably, the first and second support sections are comb-shaped, and the tongues of the first support section are substantially equal in length to the tongues of the second support section. Suitably, the first and second support sections further comprise a plurality of leg elements, each leg element extending from a base side of the support section.

Preferably, the height of each leg element is substantially the same over both the first and second bed sections. More preferably, each tongue has an associated leg element extending from the tongue on the base side of the support section. The presence of a leg beneath each tongue of the support sections provides the necessary strength in the frame in a simple manner.

Referring to FIG. 1, a preferred embodiment of the invention is a sofa bed convertible into a single bed, a double bed or two single beds.

The sofa bed frame 10 of FIG. 1 consists of a first bed section 12 and a second bed section 22, which are separable. The first bed section 12 comprises a first support section 14, leg elements 16, a backrest 18 and armrests 20. The first support section 14 is a planar sheet having a plurality of parallel tongues formed in the plane of the sheet and spaced apart along its length, so as to form a comb shape. In this embodiment the tongues are rounded at the tips, and the tongues at each end of the support section are half the width of the other tongues, having the shape of one of the other tongues bisected along its longitudinal axis of symmetry.

The leg elements 16 are rigid elements having a lower surface to abut the floor and an upper surface joined to the support section. In this embodiment each leg element 16 is a rectangular frame having one rounded corner and a rectangular segment cut out to form an aperture.

The legs 16 are disposed with their upper surfaces attached to a lower face of the first support section 14 so as to support the first support section 14 when the lower surfaces of the legs 16 are placed against the floor. A leg 16 is attached to the lower face of each of the inner tongues of the first support section 14. The backrest 18 consists of a sheet attached to a lateral face of each of the legs 16 and to the side of the first support section 14 opposite to that on which the tongues are formed. In this embodiment the backrest 18 comprises a bar 28 attached horizontally parallel to the plane of an inner face of the backrest 18. The bar 28 is fitted into the indent of each of the legs 16 and the first support section 14 is attached to an upper surface of the bar 28 and to the upper surfaces of the legs 16.

The armrests 20 each consist of a sheet having a bar 34 formed horizontally parallel to the plane of the armrest on an inner surface thereof. The armrests are disposed perpendicular to the planes of both the first support section 14 and the backrest 18 and are attached to the lateral ends of thin backrest. Upper surfaces of the bars 34 of the armrests 20 are attached to the lower faces of the end tongues of the first support section 14.

In this embodiment the backrest 18 and the armrests 20 are generally rectangular, the backrest having rounded upper corners and the armrests 20 having rounded corners on the side furthest from the backrest 18. The lower rounded corners on the armrests 20 and the legs 16 provide the advantage that the bed sections can be slid easily across a carpeted floor, and can be slid across a wooden floor with less risk of scratching. The backrest 18 has apertures formed in an upper portion above the first support section 14 and the armrests 20 each have an aperture formed in a lower portion below the first support section 14. The apertures reduce the weight of the bed without excessively reducing the strength of the bed section.

The second bed section 22 consists of a second support section 24, which is a comb-shaped sheet having a plurality of tongues spaced along its length similar to the first support section 14, and legs 26.

The second support section 24 is equal in width to the first support section 14, and the tongues are spaced along the length of the second support section 24 in positions corresponding to the spaces between the tongues of the first support section 14. At the ends of the second support section 24 half-spaces are formed, having the shape of one of the inner spaces bisected along its longitudinal axis. Similarly to the first bed section 12, in the second bed section 22 each tongue has a leg 26 attached to a lower face thereof, so that the second support section 24 is supported by the legs 26. An additional leg 26 is attached to the portion of the second support section 24 defining the half-space at either end of the second support section 24.

The legs 26 of the second bed section 22 are rectangular frames having one rounded corner. The rectangular frames provide strength and stability due to the length of their bottom surface, but are relatively light. The legs 26 of the second bed section 22 have the same height as the legs 16 of the first bed section 12 and both the first and second support sections are mounted in the same horizontal plane. The spaces between the tongues of the first support section 14 are at least as broad and deep as the tongues of the second support section 24. Conversely, the spaces between the tongues of the second support section 24 are at least as broad and deep as the tongues of the first support section 14.

Figure 3:
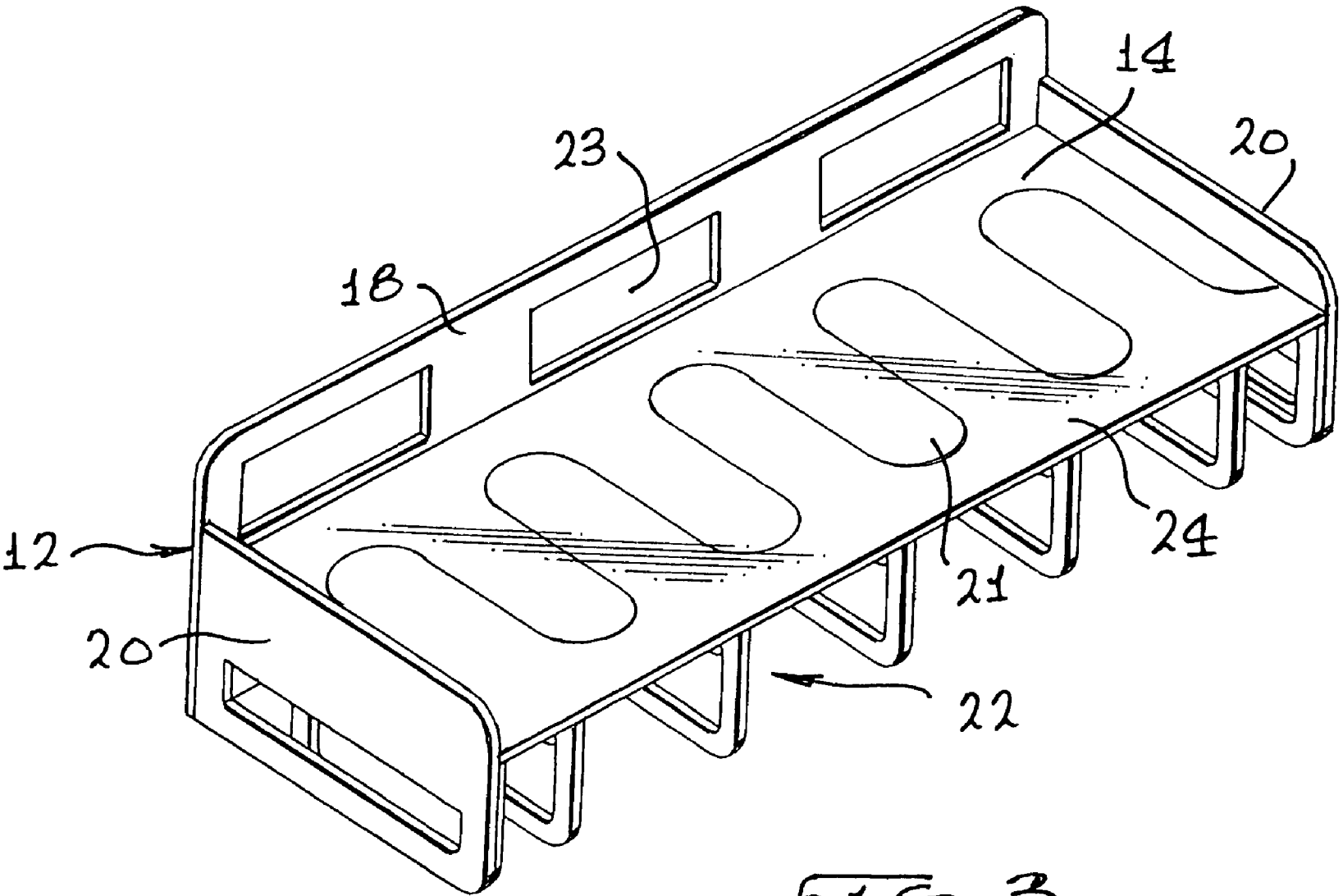
FIG. 3 illustrates a sofa bed according to the invention in a closed state.

With this construction, the comb-shaped support sections—of the first and second bed sections may be engaged so that the tongues interleave, with the tongues of one support section accommodated in the spaces between the tongues of the other, as shown in FIG. 3. In this closed state the two bed sections form a sofa frame, with the backrest 18 and armrests 20 of the first bed section performing their usual function.

Figure 4:
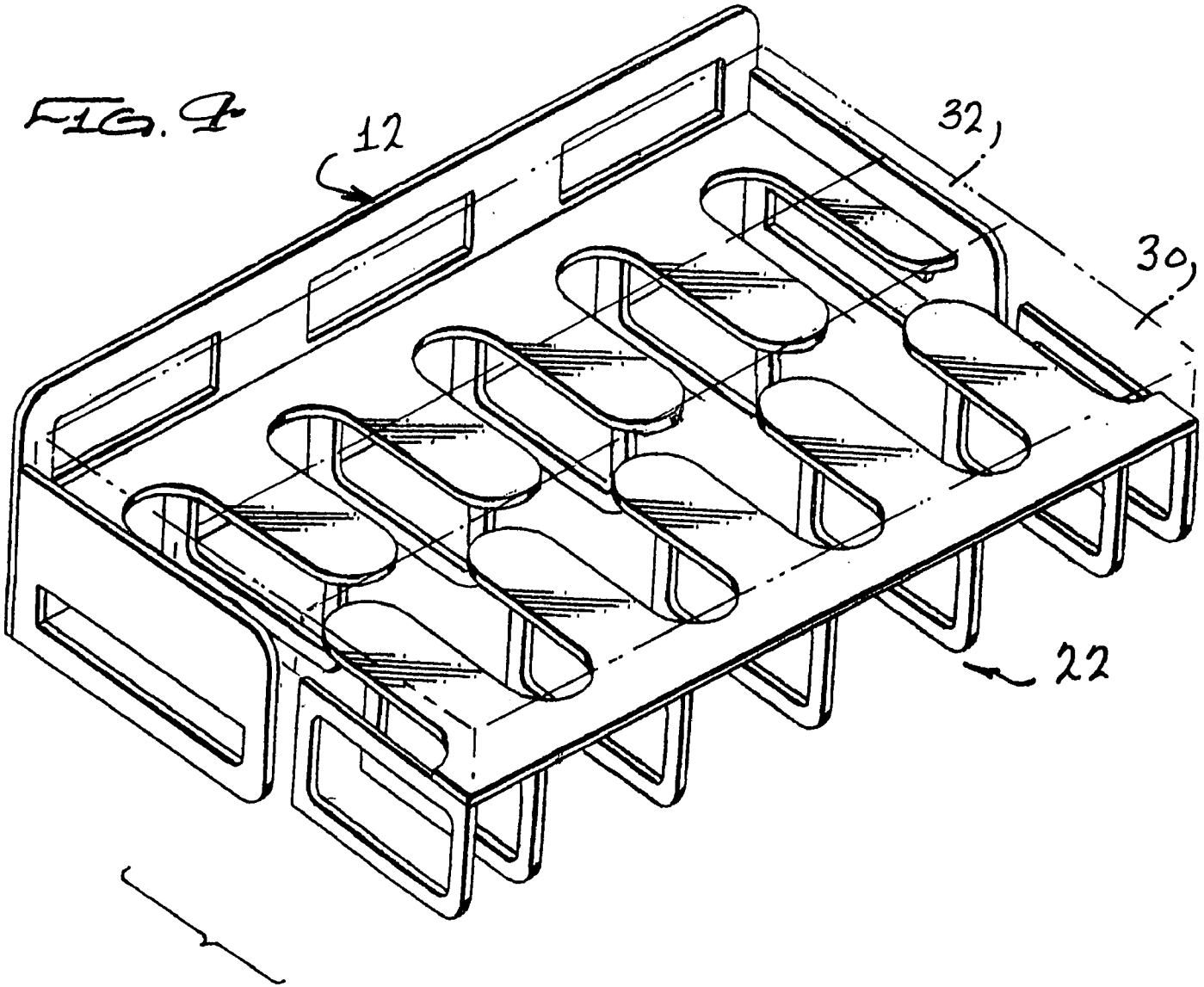
FIG. 4 illustrates a sofa bed according to the invention converted into a double bed, with a cushion in phantom.
Figure 5:
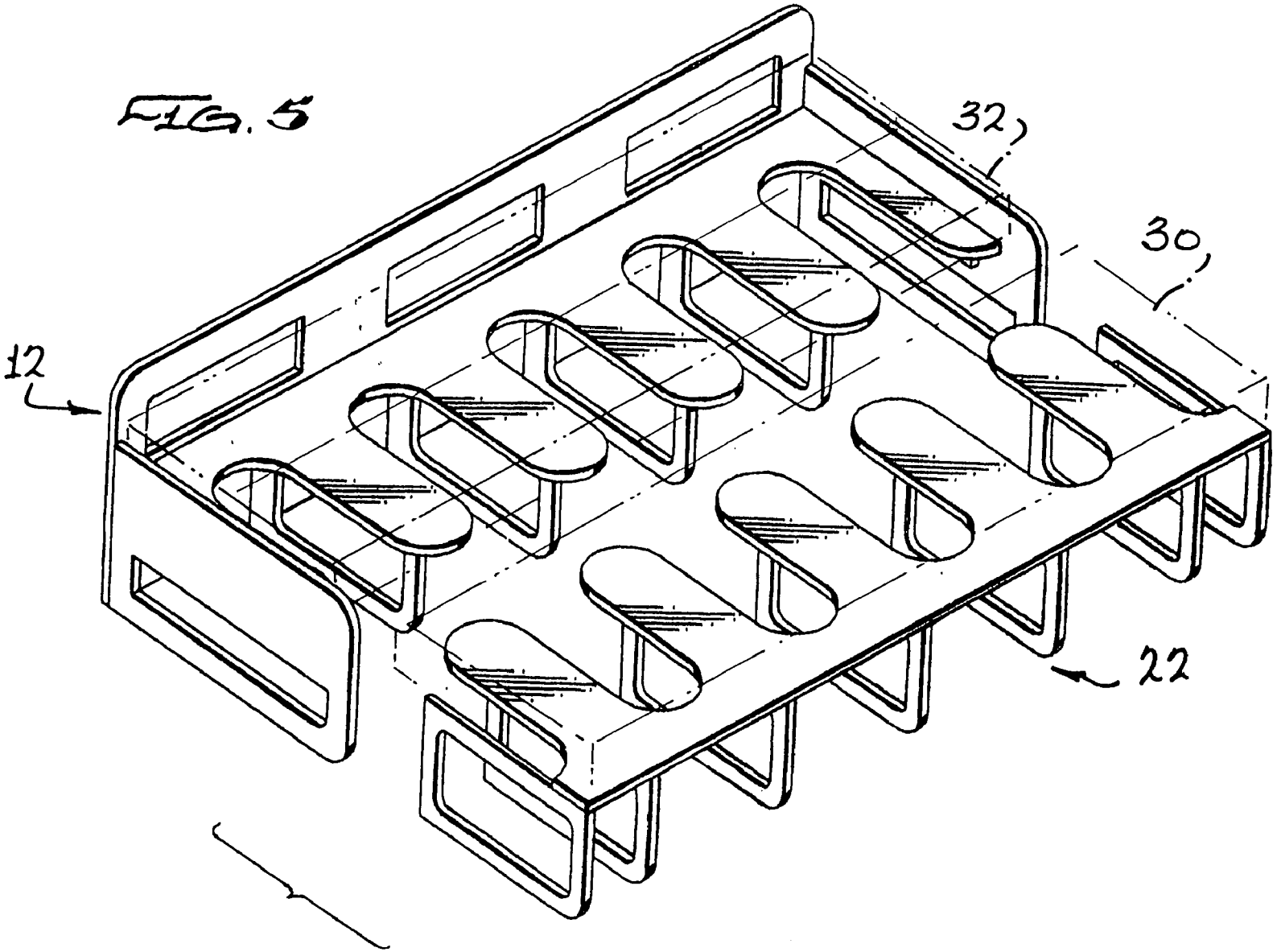
FIG. 5 illustrates a sofa bed according to the invention converted into two single beds, again with a cushion in phantom.

The width of each support section, from the linear edge of the support section to the tips of the tongues, is approximately the width of a single bed. With this construction, the sofa frame in the closed state may also be used as a single bed frame. With reference to FIG. 4, when the first and second bed sections are separated so that the tips of the tongues of the first and second support sections are aligned along the same axis, the sofa bed frame 10 forms a double bed frame. Furthermore, with reference to FIG. 5, when the first and second bed sections are separated by a greater amount, each of the bed sections forms a single bed frame. Hence, the sofa bed frame may be converted between a sofa or single bed frame, a double bed frame, and two single bed frames simply by sliding the two bed sections into the desired positions.

All of the components described above are formed from a wood material, for example 22 mm thick plywood sheet, and are attached to one another by screws.

FIG. 1 also shows a mattress and cushion arrangement used in an embodiment of the invention. The sofa bed includes a first mattress 30 and a second, foldable, mattress 32. The first mattress 30 has sufficient length and width to cover the upper surface of the first and second support sections in their interlocked state. When unfolded, the second mattress 32 is sized so as to be capable of substantially covering one of the first and second support sections in the open state. The second mattress consists of two sections of equal length and width joined by a foldable seam along their length. In this embodiment the dimensions of the first mattress are equal to the unfolded dimensions of the second mattress. The mattresses are preferably made from rubber.

For example, the first mattress 30 may be 203 cm long by 76 cm wide by 13 cm thick, and the second mattress 32 may be 203 cm, long and have two pieces 38 cm wide by 13 cm thick stitched together along a long edge and folded.

In the closed state, the first mattress 30 is placed on top of the interleaved support sections to form a support cushion, and the second mattress 32 is folded and placed against the backrest 18 to form a back cushion. When the sofa bed is converted into a bed, the first mattress 30 is placed on top of the second bed section 22 and the second mattress 32 is either removed (when forming one single bed) or unfolded and placed on top of the first bed section 12 (when forming a double bed or two single beds).

In other embodiments of the invention, any or all of the backrest 18, armrests 20, support sections and legs may be formed from a plastics material or metal. The tongues and corresponding spaces of the support sections may have any shape, provided that the support sections can be slid together into a closed state in which they are interleaved, reducing the horizontal area of the sofa bed in the closed state, and are capable of supporting a mattress individually in the open state. The tongues of one support section need not fit precisely into the spaces between the tongues of the other support section, it is only necessary that the tongues of one support section can be interleaved with the tongues of the other to some extent. There is no requirement for the two bed sections to be in contact with each other in the closed state.

The support sections may also be supported at an angle to the horizontal rather than horizontally by the legs, and the legs may be formed integrally with the support sections as may the backrest and armrests. Although each tongue of the support sections has an associated leg in the embodiment described, any number of legs may be provided, as long as the tongued bed is stable and capable of supporting the weight of the user. For example, one or both of the support sections may be supported by the armrests alone, no additional legs being required.

The two bed sections need not be completely separate from each other, provided that they are separable to some extent. For example, the bed sections may both be mounted on tracks, so that they may slide relative to one another while remaining attached, A locking mechanism may also be provided so that the bed sections may be separated up to a certain distance apart, beyond which further separation is prevented unless a particular action is performed. As an example of a locking mechanism, a section at the tip of each tongue having a greater width than the body of the tongue can be provided, such that the bed sections can only be separated by a certain distance without lifting one of the bed sections.

DESCRIPTION OF THE PRESENTLY PREFERRED EMBODIMENT

In one embodiment of the invention, the second support section is provided with a second backrest and/or armrests so that the sofa bed may be converted into two sofas in the open state. Preferably the second backrest is attached to the rear edge of the second support section in such a way that it can be removed from the second support section to avoid obstructing the second support section when the sofa bed is converted into a single sofa, and can subsequently be reattached to the second support section.

The sofa bed of the invention is also not limited to the size of the preferred embodiment.

Although several embodiments of the present invention have been described in detail for purposes of illustration, various modifications of each may be made without departing from the spirit and scope of the invention. Accordingly, the invention is not to be limited, except as by the appended claims.

I claim:

1. A convertible bed frame comprising a first bed section and a second bed section, wherein the first and second bed sections are separable;

the first bed section comprising a first support section having a plurality of tongues spaced apart along its length; and the second bed section comprising a second support section having a plurality of tongues spaced apart along its length at positions corresponding to spaces between the tongues of the first support section; wherein the first and second bed sections are movable between a closed state, in which the tongues of the first support section are interleaved between the tongues of the second support section, and an open state, in which the tongues of the first and second support sections are not interleaved; wherein each tongue of the first and second support sections has an associated leg element extending substantially parallel to the longitudinal axis of the tongue from a base side of the support sections; and wherein when bases of the leg elements are placed on a horizontal surface the support sections have a substantially horizontal upper surface in both the closed state and the open state.

2. A bed frame according to claim 1, wherein the first and second support sections are comb-shaped, and wherein the tongues of the first support section are substantially equal in length to the tongues of the second support section.

3. A bed frame according to claim 1, wherein the height of each leg element is substantially the same over both the first and second bed sections.

4. A bed frame according to claim 1, wherein when the bases of the leg elements are placed on a horizontal surface the tongues of the support elements extend in a substantially horizontal direction.

5. A bed frame according to claim 1 or claim 2, wherein each leg element comprises a rectangular frame.

6. A bed frame according to claim 1 or claim 2 wherein each leg element has at least one rounded corner on a base side thereof.

7. A sofa bed frame comprising the bed frame according to claim 1, further comprising a first backrest attachable to one of the first and second support sections.

8. A sofa bed frame according to claim 7, further comprising a second backrest attachable to the other of the first and second support sections.

9. A sofa bed frame according to claim 8, wherein the second backrest is removably attachable to the support section.

10. A sofa bed frame according to claim 7, further comprising at least one leg element, extending from a base side of one of the first and second support sections, which also forms an armrest.

11. A sofa bed frame according to claim 10, wherein each of the backrest and the armrests has at least one aperture formed therein.

12. A bed comprising the bed frame of claim 1, further comprising a first mattress and a second mattress, wherein the second mattress comprises two sections joined by a foldable seam.

13. A bed frame according to claim 1, wherein the support sections are formed from a wood material.

14. A bed frame according to claim 13, wherein the wood material is plywood sheet.

15. A kit comprising an unassembled bed frame according to claim 1.

16. A kit according to claim 15, further comprising instructions for assembling the bed frame.

* * * * *